US005615449A

United States Patent [19]

Sepke

[11] Patent Number: 5,615,449

[45] Date of Patent: Apr. 1, 1997

[54] GLASS CLEANING DEVICE

[75] Inventor: Arnold L. Sepke, Hudson, Ill.

[73] Assignee: White Consolidated Industries, Inc., Cleveland, Ohio

[21] Appl. No.: 583,290

[22] Filed: Jan. 4, 1996

[51] Int. Cl.[6] ..... A47L 1/08; A47L 9/02

[52] U.S. Cl. ..... 15/322; 15/401; 15/121

[58] Field of Search ..... 15/114, 121, 320–322, 15/393, 398, 400, 401, 402; 222/192, 321.8, 382, 464.1; 401/137–139

[56] References Cited

U.S. PATENT DOCUMENTS

| | | | |
|---|---|---|---|
| Re. 26,950 | 9/1970 | Hays | 15/321 |
| D. 173,454 | 11/1954 | Ortega . | |
| D. 318,158 | 7/1991 | Ediger et al. . | |
| 1,661,480 | 3/1928 | Keefer . | |
| 1,691,164 | 11/1928 | Monk . | |
| 1,982,345 | 11/1934 | Kirby . | |
| 2,293,115 | 8/1942 | Child . | |
| 2,741,789 | 4/1956 | Ray | 401/139 |
| 2,793,384 | 5/1957 | Ortega . | |
| 3,048,876 | 8/1962 | Kemnitz | 15/321 |
| 3,345,672 | 10/1967 | La Mers et al. . | |
| 3,464,081 | 9/1969 | Wisner . | |
| 3,538,535 | 11/1970 | Ginsburgh et al. . | |
| 3,591,889 | 7/1971 | Wisner . | |
| 4,170,805 | 10/1979 | Kumagai . | |
| 4,437,203 | 3/1984 | Wisner . | |
| 4,557,013 | 12/1985 | Belmont . | |
| 4,778,298 | 10/1988 | Shin et al. | 401/139 |
| 4,887,330 | 12/1989 | Woodhall et al. | 15/322 |
| 4,899,418 | 2/1990 | Steiner et al. . | |
| 5,046,217 | 9/1991 | Cornell et al. . | |
| 5,067,199 | 11/1991 | Alazet . | |
| 5,157,805 | 10/1992 | Pinter . | |
| 5,184,372 | 2/1993 | Mache . | |
| 5,241,724 | 9/1993 | Lim . | |
| 5,301,387 | 4/1994 | Thomas et al. . | |
| 5,328,283 | 7/1994 | Viens . | |
| 5,386,612 | 2/1995 | Sham | 15/320 |
| 5,497,530 | 3/1996 | Kamm et al. | 15/322 |
| 5,499,424 | 3/1996 | Lau | 15/322 |

FOREIGN PATENT DOCUMENTS

| | | | |
|---|---|---|---|
| WO93/02611 | 2/1993 | European Pat. Off. . | |
| 2233217 | 1/1991 | United Kingdom | 401/139 |

*Primary Examiner*—David Scherbel
*Assistant Examiner*—Terrence R. Till
*Attorney, Agent, or Firm*—Pearne, Gordon, McCoy & Granger

[57] ABSTRACT

A cleaning attachment for a vacuum cleaner including a cleaning solution reservoir, a manually operated cleaning solution dispenser mounted to the reservoir, a suction tube secured at one end to the reservoir, and a nozzle assembly. The nozzle assembly is secured to the suction tube at a location remote from the reservoir, and includes a nozzle body, a wiper assembly secured to the nozzle body, and a support arm extending from the nozzle body and beyond the reservoir. The support arm defines an opening through which the reservoir extends, and has a sponge assembly or a brush assembly interchangeably and removably secured to a distal end thereof. The dispenser engages the support arm adjacent the opening and retains the support arm in position relative to the reservoir.

21 Claims, 6 Drawing Sheets

Fig.4
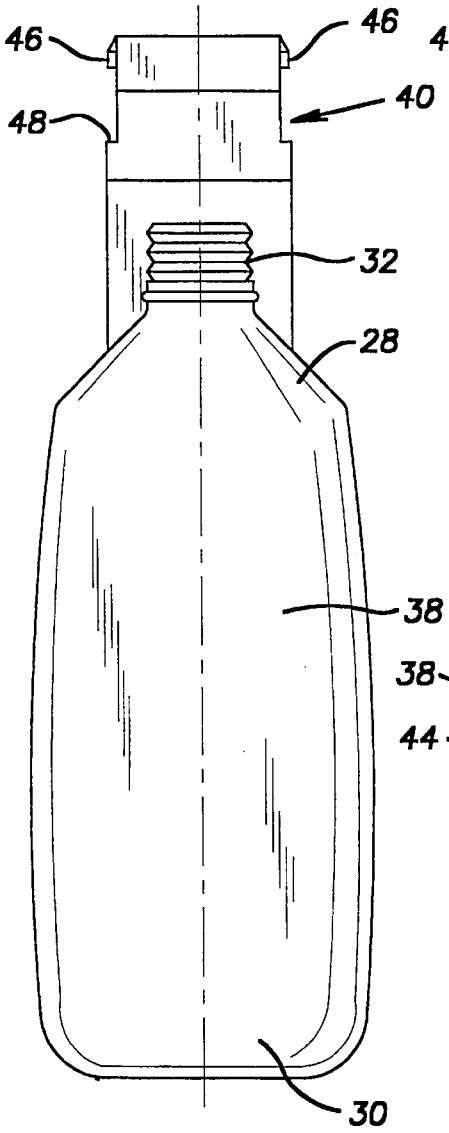
Fig.5
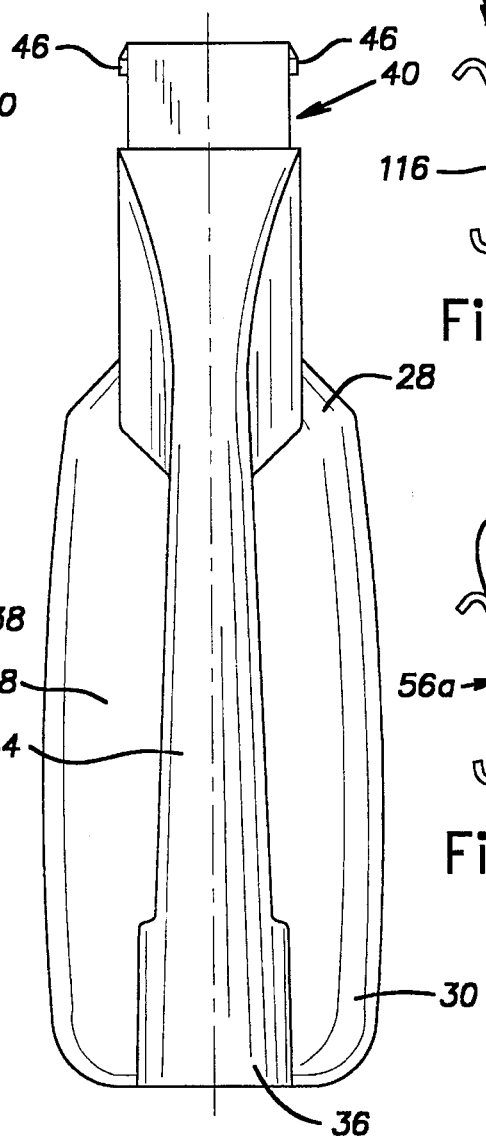
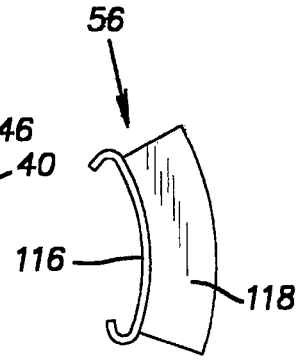
Fig.6A
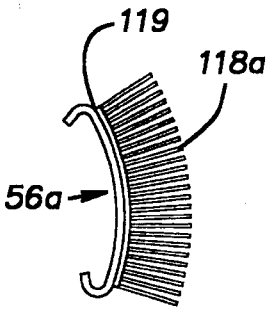
Fig.6B
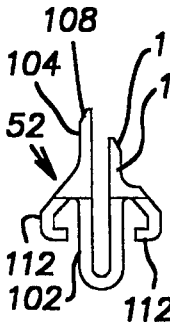
Fig.7
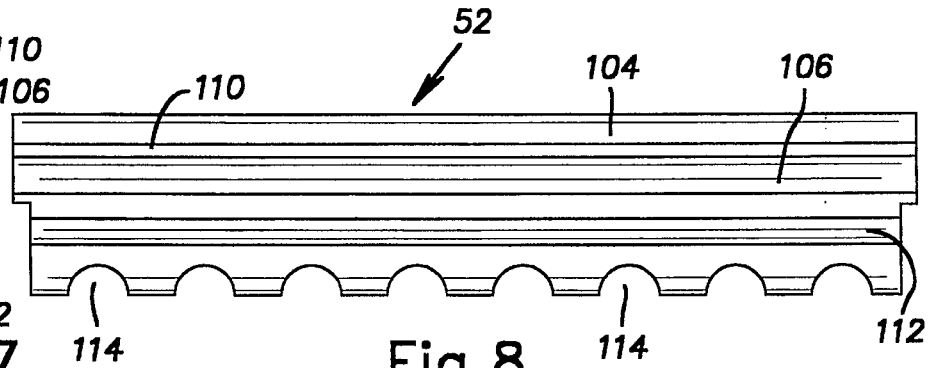
Fig.8

Fig.11
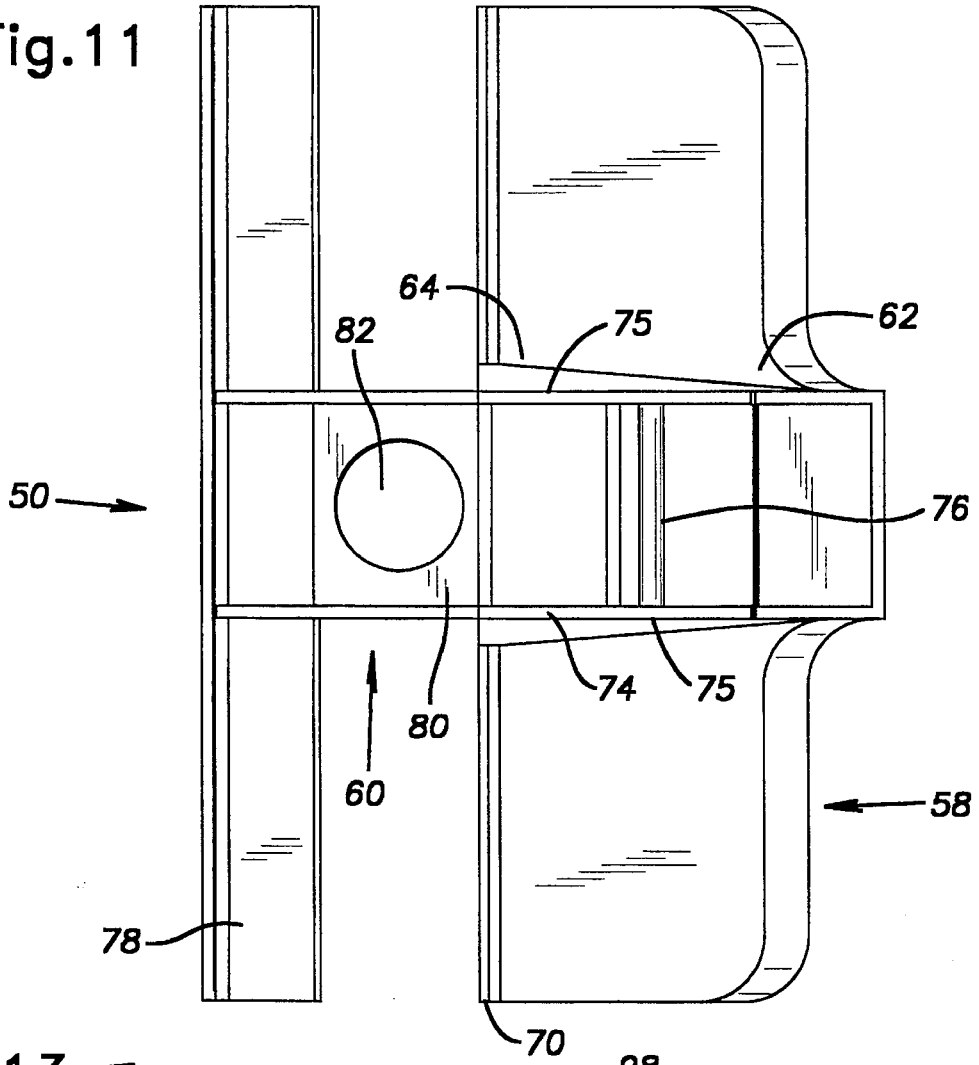
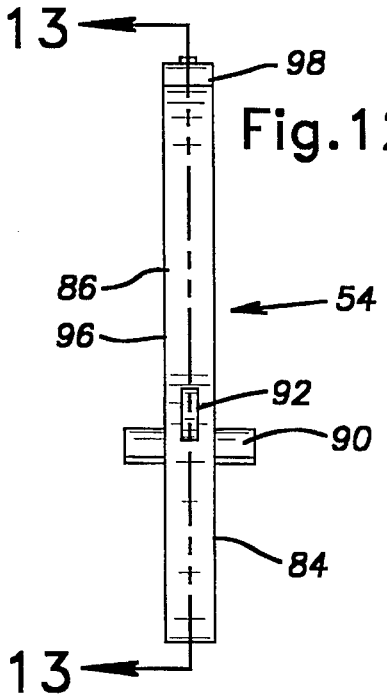
Fig.12
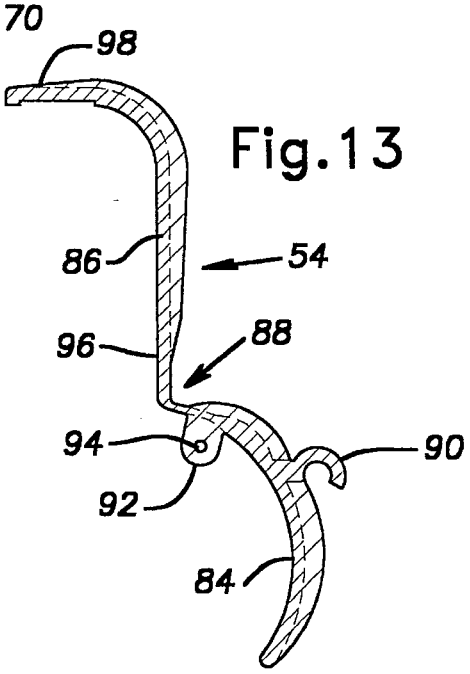
Fig.13

GLASS CLEANING DEVICE

BACKGROUND OF THE INVENTION

1. Field of the Invention

The present invention generally relates to glass cleaning devices and, more particularly, to vacuum cleaner attachments adapted to clean glass.

2. Description of Related Art

Several devices are known in the art for cleaning glass and window surfaces. These devices have, in the past, tended to be rather simple manual tools for applying cleaning solution, scrubbing the surface being cleaned, and wiping dirt and dirty cleaning solution from the newly cleaned surface.

For example, U.S. Pat. No. 5,328,283 discloses a hand held glass cleaning apparatus having a hollow body which contains cleaning fluid and on which a squeegee and a sponge cleaning fluid applicator are mounted. Cleaning fluid is gravity-fed to the sponge in a controlled manner by means of a plug which variably closes an aperture between the sponge and the hollow body.

U.S. Design Patent No. 318,518 discloses a cleaning tool having a handle which receives a spray pump, and on which is mounted a squeegee and a sponge. See also, U.S. Design Patent No. 173,454.

Other window or glass surface cleaning devices have been more complex, and have applied suction to the surface being cleaned to extract or remove dirt and dirty cleaning solution therefrom.

For example, U.S. Pat. No. 5,301,387 discloses a cleaning head for a vacuum cleaner having a sponge, a pair of brushes, a pair of squeegees, and a tube for supplying cleaning fluid to the sponge. The cleaning fluid is supplied from a reservoir separate from the cleaning head and the sponge is in contact with the surface to be cleaned at the same time as the squeegee.

Other references show window or wall cleaning devices which supply wash water or fluid from a remote source and use a squeegee in combination with suction to remove the dirty cleaning fluid from the surface being cleaned. See, for example, U.S. Pat. Nos. 1,691,164; 1,982,345; 3,345,672; 3,464,081; 3,591,889; and 4,170,805.

The devices which use a source for cleaning solution remote from the cleaning device are generally dedicated to window, glass, or wall cleaning, and are therefore not usable as an attachment to a conventional wet/dry vacuum cleaner. Moreover, these devices are typically expensive to manufacture and require separate pump means to supply the cleaning solution to the remote area being cleaned.

There exists a need in the art for an improved glass or window cleaning attachment for a vacuum cleaner which is easy to use, which allows the user to easily apply cleaning solution to the surface to be cleaned, and which is quickly and simply attachable to a vacuum cleaner suction hose.

SUMMARY OF THE INVENTION

The present invention provides an improved glass or window cleaning attachment for a vacuum cleaner which removes or eliminates at least some of the disadvantages and shortcomings found in the prior art. The cleaning attachment according to the present invention is an economical attachment for a wet-dry vacuum cleaner, and is designed to quickly clean glass windows, mirrors, shower doors, table tops, formica counter tops, etc. The cleaning attachment is also adapted for cleaning fabrics, and may be used to clean spots from upholstery, drapes, curtains, rugs, and carpet.

In accordance with the present invention, the cleaning attachment includes a cleaning solution reservoir and a suction tube. The reservoir and suction tube are attached at one end thereof, and extend away from each other to define a generally U-shaped body for the attachment.

In further accordance with the present invention, a manually operable cleaning solution dispenser is attached to a distal end of the reservoir. The dispenser is user-operated, and serves to dispense cleaning solution from the reservoir onto a surface to be cleaned.

A nozzle assembly is secured to a distal or inlet end of the suction tube. The nozzle assembly includes a nozzle body, a wiper assembly secured to the nozzle body, and a support arm extending outwardly from the nozzle body and the suction tube and beyond the reservoir. A distal end of the support arm has a replaceable sponge assembly secured thereto. The sponge assembly is interchangeable with a replaceable brush assembly, either of which may be used to scrub or loosen dirt from a surface being cleaned.

In further accordance with the present invention, a user-engageable trigger assembly is pivotally mounted to the support arm. The trigger assembly includes a trigger portion which extends downwardly from the support arm and an actuating portion which extends upwardly from the support arm and engages the cleaning solution dispenser. Lateral movement of the trigger portion causes vertical movement of the actuating portion, and actuates the cleaning solution dispenser.

In further accordance with the present invention, the support arm defines an opening through which the distal end of the reservoir extends, and the dispenser engages the support arm at a location adjacent the opening. Engagement of the dispenser with the support arm serves to retain the support arm in position relative to the reservoir.

BRIEF DESCRIPTION OF THE DRAWING FIGURES

These and further features of the present invention will be apparent with reference to the following description and drawings, wherein:

FIG. 4 is a front elevational view of the suction tube and cleaning solution reservoir shown in FIG. 3;

FIG. 5 is a rear elevational view of the suction tube and cleaning solution reservoir shown in FIGS. 3 and 4;

FIG. 6A is a side elevational view of a sponge assembly in accordance with the present invention;

FIG. 6B is a side elevational view of a brush assembly in accordance with the present invention;

FIG. 7 is a side elevational view of a wiper assembly in accordance with the present invention;

FIG. 8 is a front elevational view of the wiper assembly shown in FIG. 7;

Figure 3:
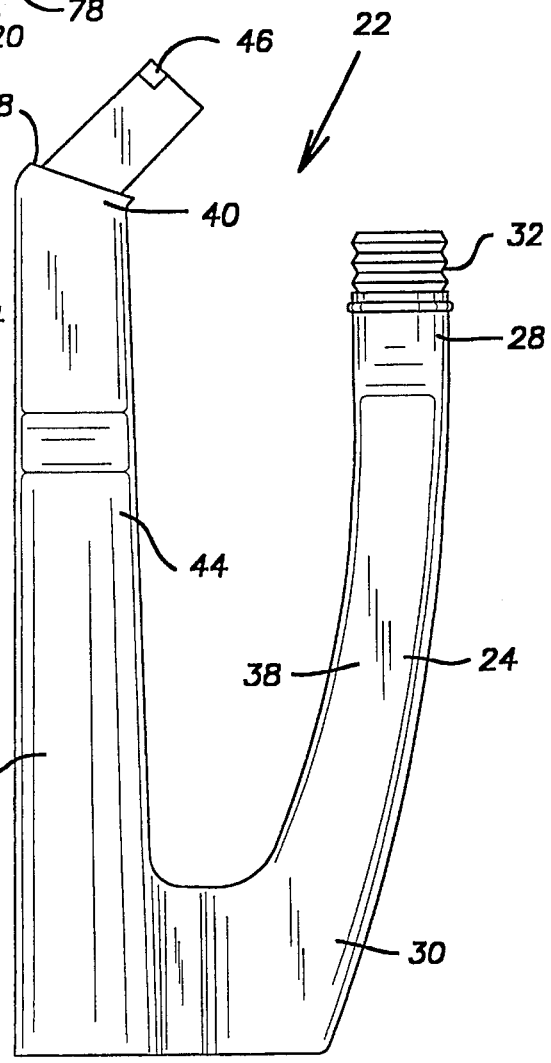
FIG. 3 is a side elevational view of a suction tube and cleaning solution reservoir in accordance with the present invention.
Figure 9:
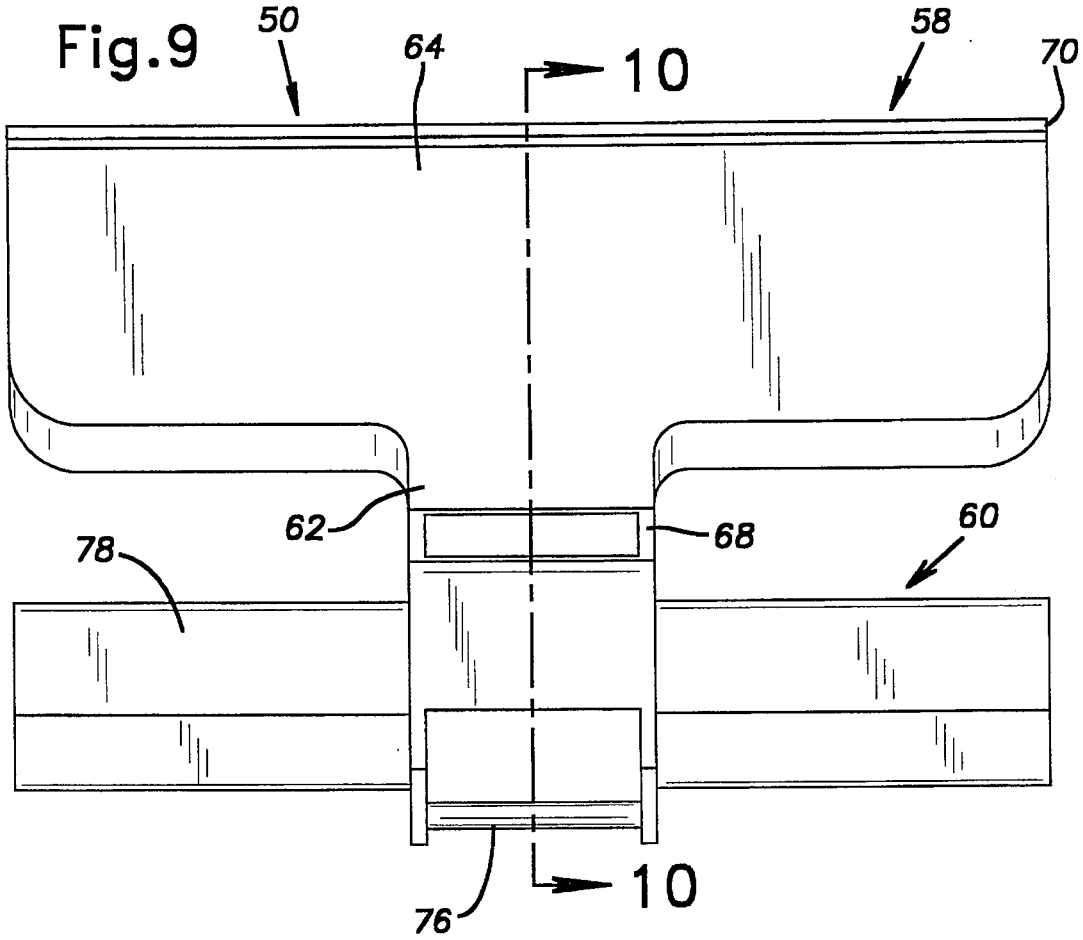
FIG. 9 is a top plan view of a nozzle assembly according to the present invention.
Figure 10:
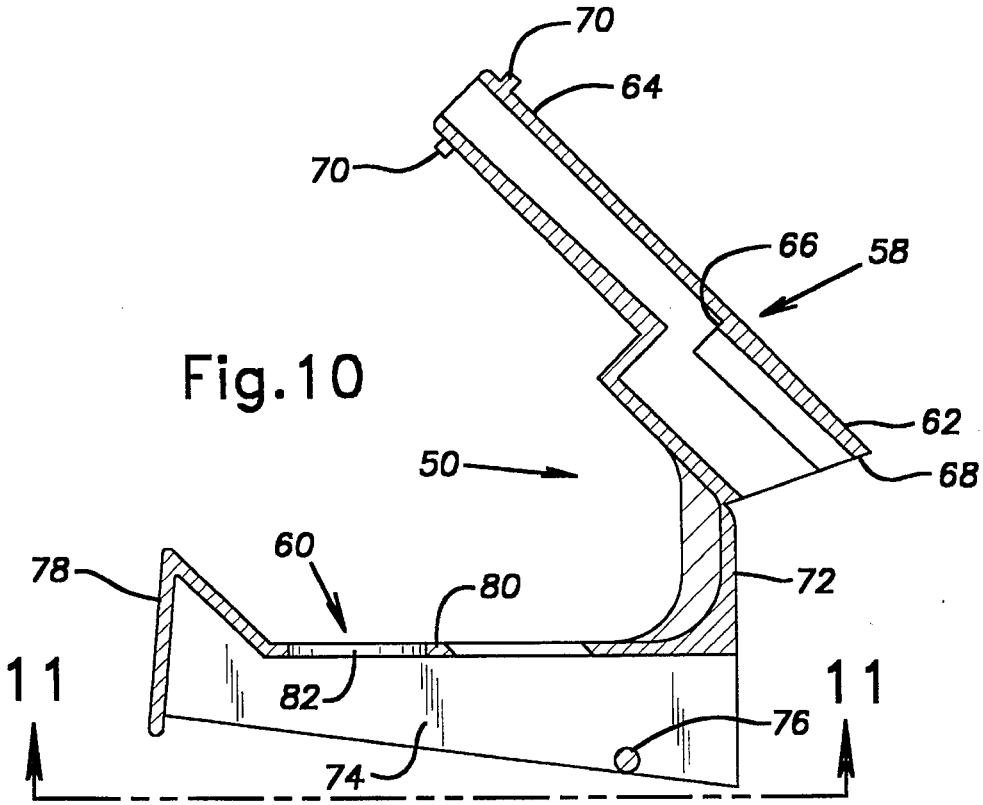
FIG. 10 is a cross sectional view of the nozzle assembly as seen along line 10—10 of FIG. 9.
Figure 14:
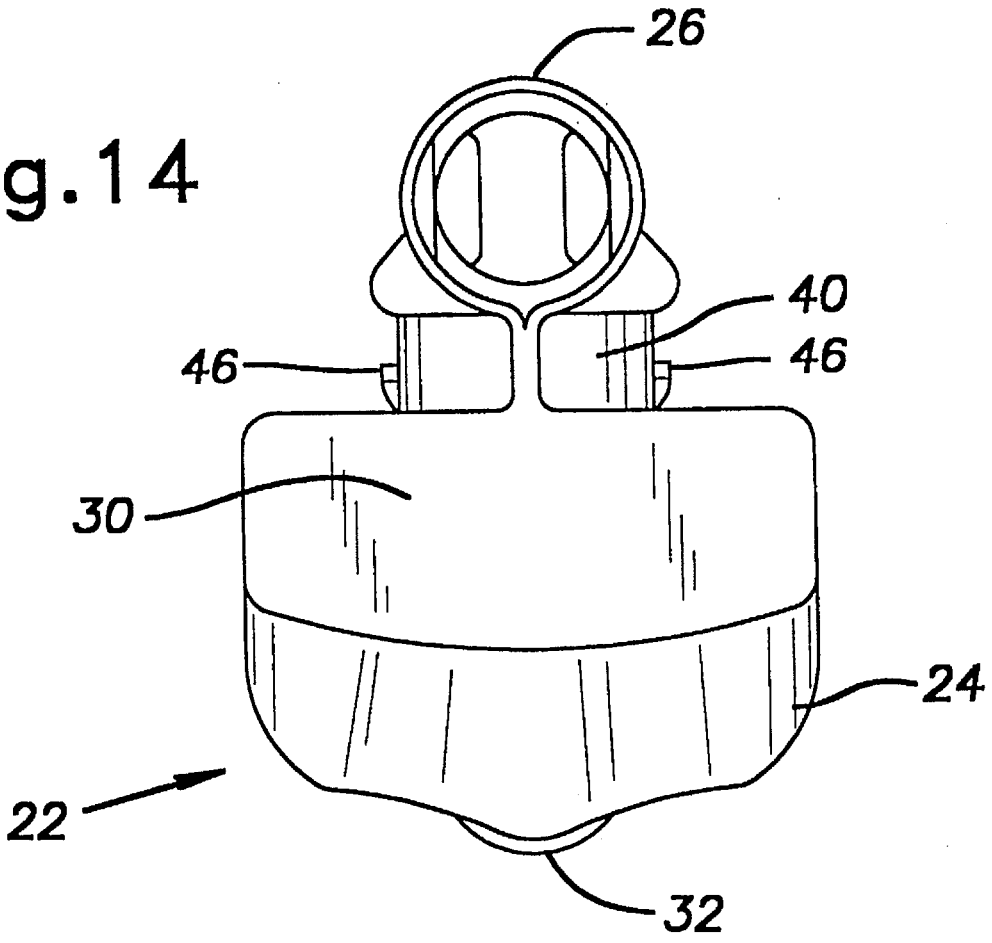

FIG. 11 a bottom plan view of the nozzle assembly shown in FIGS. 9 and 10;

FIG. 12 is a elevational view of a trigger assembly according to the present invention;

FIG. 13 is a cross sectional view of the trigger assembly as seen along line 13—13 of FIG. 12;

FIG. 14 is a bottom plan view of the suction tube and cleaning solution reservoir shown in FIGS. 3–5.

DETAILED DESCRIPTION OF THE PREFERRED EMBODIMENT

Figure 1:
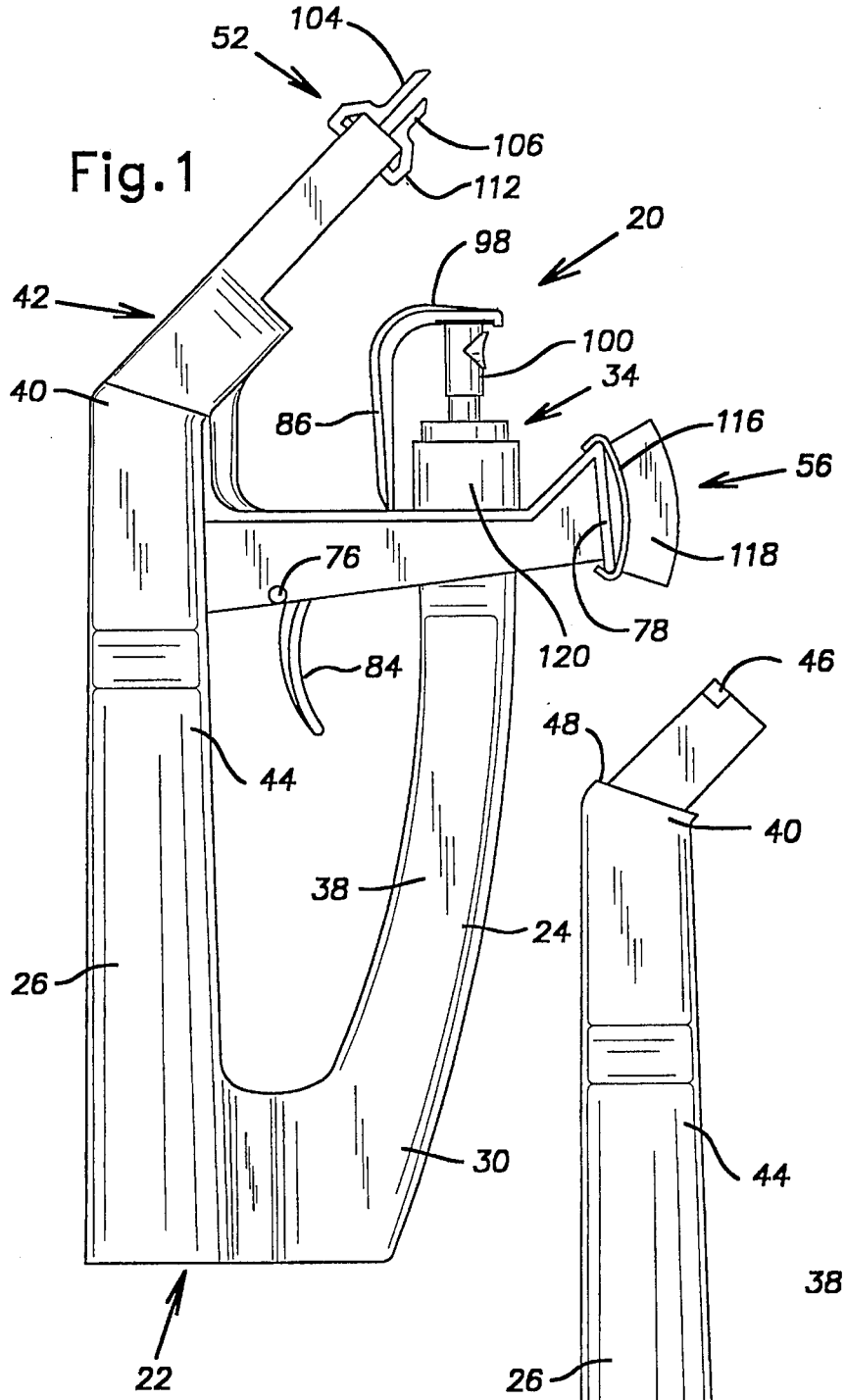
FIG. 1 is a side elevational view of a cleaning attachment in accordance with the present invention.
Figure 2:
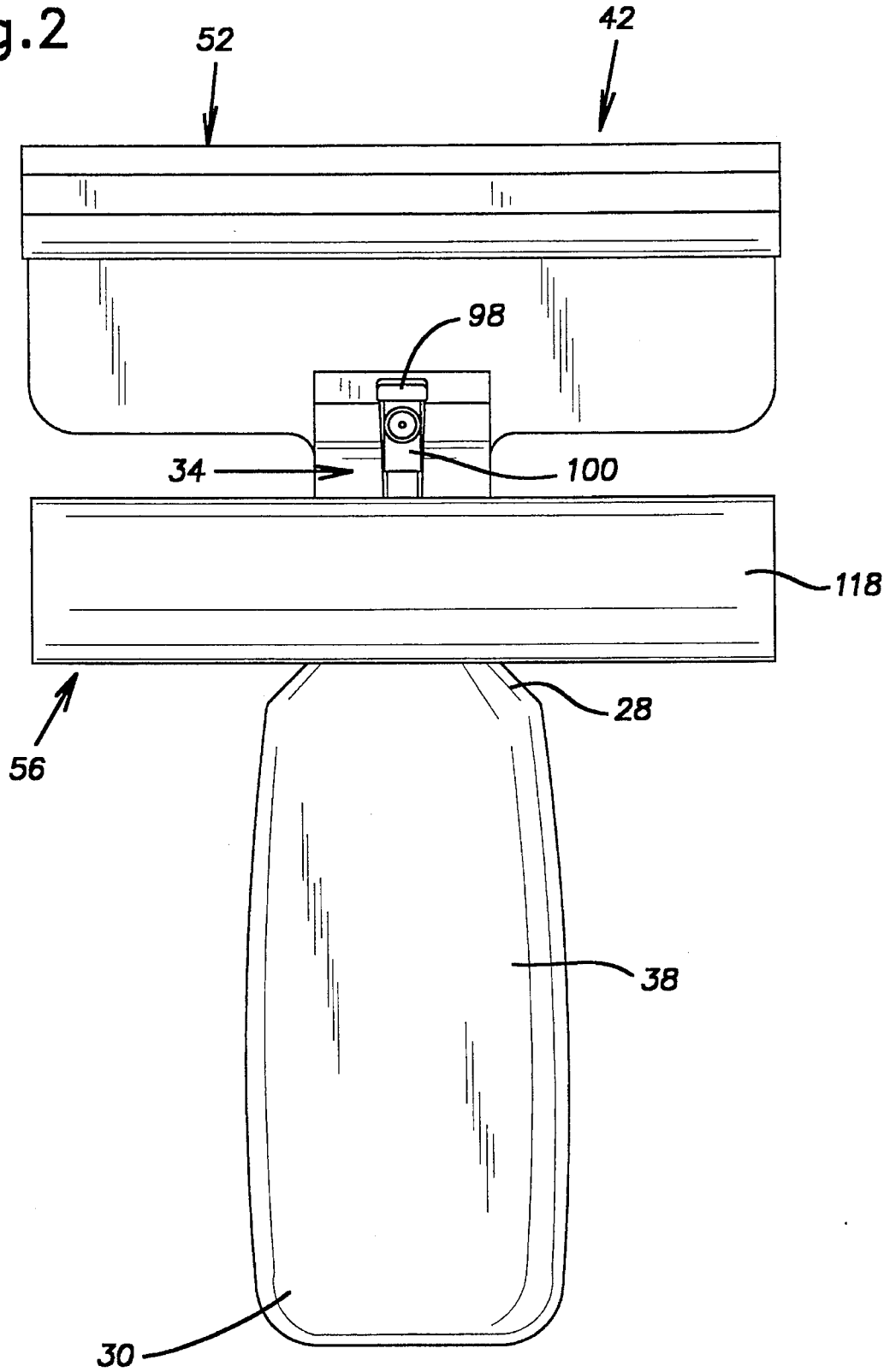
FIG. 2 is a front elevational view of the cleaning attachment shown in FIG. 1.

With reference to FIGS. 1–5, a cleaning device 20 according to the present invention is illustrated. The cleaning device 20 includes a generally U-shaped body 22, when viewed from a side (FIG. 1), defined by a cleaning solution receptacle or reservoir 24 which is integrally molded with a hollow suction tube 26. The reservoir 24 is open at a top or distal end 28, and is closed at a bottom or proximal end 30. The distal end 28 includes an externally threaded portion 32 to permit threaded attachment of a manual cleaning solution dispenser 34 thereto, as will be described more fully hereafter. The proximal end 30 of the reservoir 24 is integrally molded with a proximal or bottom end 36 of the suction tube 26. With reference to FIGS. 2 and 4–5, the reservoir 22 is shown to have an enlarged hollow body portion 38 adapted to receive and store a quantity of cleaning solution.

As shown best in FIGS. 1 and 3, the suction tube 26 preferably extends generally axially, while the reservoir 24 is arcuate or slightly curved away from the suction tube. A distal end 40 of the suction tube 26 is adapted to receive a nozzle assembly 42, and is angled or bent away from the axis of the suction tube 26 and toward an extension or projection of the reservoir 24. The suction tube distal end 40 is at a location vertically and laterally displaced from the distal end 28 of the reservoir, as illustrated.

The suction tube is tapered along its length to provide an ergonomic handle or gripping portion 44 which permits the user to easily grasp and control movement of the cleaning device 20. The distal end 40 of the suction tube 26 is generally rectangular in cross-section, and provides a tab-like projection 46 (FIGS. 4, 5) and a stop surface 48 which cooperate with mating structures on the nozzle assembly 42 to limit insertion of the suction tube distal end 40 into the nozzle assembly 42, and to secure the nozzle assembly 42 to the suction tube 26, as will be discussed more fully hereafter.

Preferably, the body 22 of the cleaning device 20, i.e., the suction tube 26 and reservoir 24, is integrally blow molded from a thermoplastic material, such as HDPE. Pinching at the proximal end 30 of the reservoir 24 serves to seal the reservoir 24 from the suction tube 26 (FIG. 14). It is also contemplated that the cleaning device body 22 could be made by alternate means, such as rotational molding, injection molding, or could be assembled from two or more pieces. Although HDPE is a preferred material due to its low cost, ready availability, impact resistance, and immunity to the effects of chemicals that may be contained in the reservoir 26, it is contemplated that other thermoplastic materials could be used.

The nozzle assembly 42 is illustrated in FIGS. 9–11, with the individual components of the nozzle assembly being shown in FIGS. 6A–8 and 12–13. The nozzle assembly includes a nozzle body 50, a wiper 52, a trigger assembly 54, and a sponge assembly 56. The sponge assembly 56 is interchangeable with a brush assembly 56*a*.

With specific reference to FIGS. 9–11, the nozzle body 50 is shown to include a suction tube extension 58 and an integral support arm 60. The suction tube extension 58 includes a first end 62 which is secured to the distal end 40 of the suction tube 26, and a second end 64 to which the wiper 52 is secured. The suction tube extension 58 defines a suction passageway through which dirt and dirty cleaning solution are conducted from the second end 64 of the extension to the suction tube 26. The suction passageway at the first end 62 of the suction tube extension 58 closely matches the size of the suction tube distal end 40, and is slidably received over the suction tube distal end.

An internal ledge or projection 66 provided by the first end 62 is engaged by the tab-like projection 46 provided by the suction tube distal end 40 to snap-lock the nozzle body 50 onto the suction tube 26. A terminal surface 68 of the first end 62 is adjacent or in engagement with the stop surface 48 provided by the suction tube distal end 40, and limits insertion of the suction tube into the nozzle body 50. The ledge 66 and tab-like projection 46 cooperate to provide a snap-lock connection to simply and permanently affix the suction tube extension 58 to the distal end 40 of the suction tube 26, as briefly noted hereinbefore.

The second end 64 of the suction tube extension 58 is much wider than the first end 62, while the suction passage provided by the second end 64 is more narrow than that of the first end 62 (FIGS. 9–10). The second end 64 has a pair of elongated ribs 70 extending therefrom, and defines a nozzle head to which the wiper 52 is secured.

The support arm 60 includes a connecting portion 72 which extends integrally from the suction tube extension 58, and a body portion 74 which extends outwardly and generally perpendicular to the connecting portion 72. The connecting portion 72 is in close engagement with the suction tube 26, as illustrated best in FIG. 1, and serves to brace the support arm.

The body portion 74 includes a pair of spaced-apart panels 75 which are interconnected by a transverse axle 76 and an upper panel 80 (FIG. 11). The transverse axle 76 defines an axis about which the trigger assembly 54 pivotally moves, as will be apparent from the discussion to follow. A distal end 78 of the body portion 74 is elongated, and has the sponge assembly 56 mounted thereto.

The upper panel 80 of the body portion 74 defines an opening 82 (FIG. 11) through which the threaded distal end 28 of the reservoir 24 extends or projects. As will be described more fully hereafter, the manual cleaning solution dispenser 34 is mounted over the support arm 60 and engages the support arm body portion 74 adjacent the opening 82 to retain the support arm 60 in position relative to the reservoir 24.

Preferably, the nozzle body 50, i.e., the suction tube extension 58 and the support arm 60, is integrally injection molded from a thermoplastic material, such as HDPE. It is also contemplated that the nozzle body 50 could be made by alternate means, such as rotational molding, blow molding, or could be assembled from two or more pieces. Although HDPE is a preferred material due to its low cost, ready availability, impact resistance, and immunity to the effects of chemicals that may be drawn through the nozzle body 50, it is contemplated that other thermoplastic materials could be used.

The trigger assembly 54 (FIGS. 12–13), which is preferably formed from polypropylene, permits convenient and ergonomic operation of the manual cleaning solution dispenser 34. The trigger assembly 54 includes an arcuate trigger portion 84, an actuating portion 86, and a reduced thickness interconnecting portion 88.

The trigger portion 84 includes a semi-cylindrical connector 90 and a tab 92. The semi-cylindrical connector 90 is snap-fitted over the transverse axle 76 of the support arm 60 to pivotally mount the trigger assembly 54 to the support arm 60. The tab 92 includes an eyelet or opening 94 through which an actuating cable or rod (not shown) may extend to permit the dispenser 34 to be remotely operated when the cleaning device 20 is mounted to a rigid suction wand (not shown), as will be described more fully hereafter.

The actuating portion 86 has a proximal end 96 adjacent the interconnecting portion 88 and a distal end 98 which snaps over a head 100 of the dispenser 34, as illustrated in FIG. 1. The interconnecting portion 88 has a reduced thickness, as compared to the actuating and trigger portions, so as to concentrate flex at the interconnecting portion 88 and to define a flexible "living hinge" whereby pivotal movement of the trigger portion 84 about the transverse axle 76 is translated into generally vertical motion in the actuating portion 86 to reciprocally move the dispenser head 100 up and down.

With reference to FIGS. 7 and 8, the wiper 52 is shown as an extruded flexible or elastic member having a generally U-shaped main body section 102 defining first and second laterally spaced wiping blades 104, 106, each blade having a terminal wiping surface 108, 110 designed and adapted to engage a surface being cleaned and wipe or "squeegee" cleaning solution and dirt therefrom. The terminal wiping surfaces 108, 110 are vertically offset from one another, as illustrated.

The wiper 52 includes a pair of mounting flanges or hooks 112 laterally outboard of a related blade 104, 106. The mounting flanges or hooks 112 serve to secure the wiper 52 to the second end 64 of the suction tube extension 58. More specifically, the mounting flanges 112 are snap-fit over the ribs 70 provided on the second end 64 of the suction tube extension 58 to removably secure the wiper to the suction tube extension 58. The U-shaped main body 102 of the wiper 52 is inserted into the second end 64 of the suction tube extension, and suction is communicated to the area between the wiper blades 104, 106 through openings 114 in the base of the wiper main body section 102. As such, the wiper 52 defines an inlet through which dirt and dirty cleaning solution enters the suction tube extension 58, and communicates suction generally uniformly between the blades 104, 106 along the length of the wiper 52.

FIG. 6A shows the sponge assembly 56 which is removably secured to the distal end 78 of the support arm body portion 74. The sponge assembly 56 includes a mounting clip 116 which is secured to a sponge 118. The sponge 118 may be employed by the user to loosen dirt or soil from the surface being cleaned. The mounting clip 116 is preferably an extruded plastic part to which the sponge 118 is adhesively secured. The clip 116 is designed to be easily and removably secured to the support arm 60. The sponge assembly 56 is intended to be a replaceable part, replacement being necessary when the sponge 118 becomes worn after repeated use.

The sponge assembly 56 is interchangeable with the brush assembly **56*a* (FIG. 6B), as noted hereinbefore. The brush assembly 56*a* includes a mounting clip 116*a* and a bristle brush head 118*a*. The brush assembly mounting clip 116*a* is preferably an extruded plastic part and is substantially identical to the sponge assembly mounting clip 116. The brush head 118*a* includes a backing sheet 119 that is adhesively secured to the brush mounting clip 116*a*, the bristles of the brush head 118*a* extending from the backing sheet 119 and outwardly away from the mounting clip 116*a***, as illustrated.

The brush assembly **56*a* is interchangeable with the sponge assembly 56, and permits the user to more vigorously brush or scrub a dirty surface. Such a surface could be a particularly dirty window, or fabric such as upholstery or carpet. The brush assembly 56*a* permits the cleaning device of the present invention to be used more easily and efficiently to clean spots or dirt from such surfaces. Naturally, it is contemplated that the preferred brush assembly 56*a* specifically shown and described herein may be replaced by numerous, equivalent structures having a relatively coarse or rigid surface, as compared to the sponge 118**, to facilitate scrubbing or vigorous rubbing of the surface being cleaned.

The cleaning solution dispenser 34 includes, in addition to the dispenser head 100, a cap member 120 and a dispenser tube (not shown). The dispenser tube extends downwardly from the dispenser head 100 into the cleaning solution reservoir 24 and defines a passageway through which cleaning solution is drawn by reciprocating up-and-down movement of the dispenser head 100. The cap member 120 is threaded over the threaded portion 32 of the reservoir distal end 28. The cap member 120 engages a surface of the upper panel 80 of the support arm body portion 74 radially adjacent the opening 82 through which the distal end 28 of the reservoir extends. As such, the cap member 120 of the cleaning solution dispenser 34 serves to unify or integrate the support arm 60 with the reservoir 24, which stiffens or strengthens the resulting cleaning device 20.

Assembly of the cleaning device 20 will be described hereafter with reference to the foregoing description and drawings.

Initially, the mounting clip 116 of the sponge assembly 56 is pushed onto the distal end 78 of the support arm body portion 74. The body portion 102 of the wiper 52 is inserted into the second end 64 of the suction tube extension 58, and the mounting flanges or hooks 112 of the wiper 52 are placed around the ribs 70 projecting from the suction tube extension second end 64.

Thereafter, the first end 62 of the suction tube extension 58 is pushed onto the distal end 40 of the suction tube 26 until the tab-like projection 46 of the distal end 40 snaps over the ledge or projection 66 provided by the suction tube extension first end 62 to secure the nozzle body 50 to the suction tube 26.

As so assembled, the connecting portion 72 of the support arm 60 is in close engagement with the suction tube 26, and the support arm body portion 74 extends outwardly from the suction tube 26 and beyond the cleaning solution reservoir 24.

The distal end 28 of the reservoir extends through the opening 82 in the upper panel 80 of the support arm body portion 74, with the threaded portion 32 of the reservoir distal end 28 extending above the support arm body portion upper panel 80. The cap member 120 of the manual cleaning solution dispenser 34 is threaded onto the threaded portion 32 of the reservoir 24 until the cap member 120 engages the upper panel 80 of the support arm body portion 78.

The trigger assembly 54 is secured to the nozzle assembly 42 by pushing the semi-cylindrical connector 90 over the transverse axle 76. Then the distal end 98 of the trigger assembly actuating portion 86 is mounted over the cleaning solution dispenser head 100. The interconnecting portion 88 of the trigger assembly 54 is received within the support arm body portion 74 (i.e., between the panels 75), and the actuating portion 86 extends upwardly therefrom between the support arm body portion upper panel 80 and the transverse axle 76.

At this point, the cleaning device 20 is fully assembled and is, upon filling of the reservoir 24 with cleaning solution and attachment of the suction tube proximal end 36 to a vacuum cleaner suction tube (not shown), ready for use.

During hand-held use, the suction tube 26 is grasped at the handle portion 44, and cleaning solution is dispensed from the reservoir by moving the arcuate trigger portion 84 laterally back-and-forth. Due to the "living hinge" provided by the interconnecting portion 88 of the trigger assembly 54, lateral movement of the trigger portion is translated into vertical (up-and-down) movement of the trigger actuating portion 86 and the cleaning solution dispenser head 100, and causes cleaning solution to be dispensed or "squirted" from the reservoir 24 and onto a surface to be cleaned.

Once the surface is sufficiently soaked or coated with cleaning solution, the user can scrub the surface with the sponge 118 provided at the support arm distal end 78 to loosen any built-up soil or dirt from the surface being cleaned. If the dirt is particularly heavy, the sponge assembly 56 can be replaced with the brush assembly **56*a***.

After the dirt is sufficiently loosened from the surface being cleaned, the user can slide the wiper 52 across the surface being cleaned to "squeegee" and extract dirt and dirty cleaning solution therefrom. Suction provided by the vacuum cleaner (not shown) via the vacuum cleaner suction tube and the cleaning device suction tube 26 draws dirt and dirty cleaning solution into the second end 64 of the suction tube extension 58 (and, eventually, the suction tube 26) via the suction passageway defined by the space between the wiper blades 104, 106, and the openings 114 in the base of the wiper main body section 102.

The cleaning device 200 of the present invention is also adapted for use in situations wherein the device is not grasped by the user, i.e., when an extended rigid suction wand (not shown) is inserted into the proximal end 36 of the suction tube 26, as would be desirable for cleaning high windows or glass surfaces. In this situation, a control cable or rod (not shown) is attached to the trigger assembly 54 by insertion through the eyelet 94 formed in the tab 92. Cleaning solution is dispensed from the reservoir 24 by moving the cable or rod up-and-down which, in turn, moves the actuating portion 86 and the dispenser head 100 in a reciprocating up-and-down manner.

If the cleaning device 20 is to be used to remove dirt or spots from fabrics, the sponge assembly 56 is replaced with the brush assembly **56*a*, and the wiper 52 is removed from the second end 64 of the suction tube extension 58. The brush head 118*a* is used to scrub the dirty fabric surface, and fluid and entrained dirt is drawn through the second end 64 of the suction tube extension 58 and the suction tube 26**.

While the preferred embodiment of the present invention is shown and described herein, it is to be understood that the same is not so limited but shall cover and include any and all modifications thereof which fall within the purview of the invention, as defined by the claims appended hereto.

What is claimed is:

1. A cleaning attachment for a vacuum cleaner, comprising:

a cleaning solution reservoir having a closed proximal end and an open distal end;

a manually operable cleaning solution dispenser removably secured to the distal end of said reservoir;

a suction tube attached to, and extending away from, the proximal end of said reservoir, said suction tube having a distal end spaced from said reservoir;

a nozzle assembly secured to the distal end of said suction tube, said nozzle assembly including a nozzle body, a wiper secured to said nozzle body, and a support arm extending outwardly from said nozzle body and beyond said reservoir.

2. A cleaning attachment for a vacuum cleaner according to claim 1, further comprising:

a trigger assembly secured to said support arm and manually operable to actuate said cleaning solution dispenser and thereby dispense cleaning solution from said reservoir.

3. A cleaning attachment for a vacuum cleaner according to claim 2, wherein the support arm defines an opening through which the reservoir extends.

4. A cleaning attachment for a vacuum cleaner according to claim 3, wherein said cleaning solution dispenser engages and retains said support arm in position relative to said reservoir.

5. A cleaning attachment for a vacuum cleaner according to claim 2, wherein said trigger assembly is pivotally mounted to said support arm and includes a trigger portion which extends downwardly from said support arm and an actuating portion which extends upwardly from said support arm and engages said cleaning solution dispenser whereby lateral movement of said trigger portion causes vertical movement of said actuating portion, and pumps cleaning solution from said reservoir through said dispenser.

6. A cleaning attachment for a vacuum cleaner according to claim 1, further comprising a sponge assembly secured to a distal end of said support arm.

7. A cleaning attachment for a vacuum cleaner according to claim 6, further comprising:

a trigger assembly secured to said support arm and manually operable to actuate said cleaning solution dispenser and thereby dispense cleaning solution from said reservoir.

8. A cleaning attachment for a vacuum cleaner according to claim 7, wherein the support arm defines an opening through which the reservoir extends.

9. A cleaning attachment for a vacuum cleaner according to claim 8, wherein said cleaning solution dispenser engages and retains said support arm in position relative to said reservoir.

10. A cleaning attachment for a vacuum cleaner according to claim 7, wherein said trigger assembly is pivotally mounted to said support arm and includes a trigger portion which extends downwardly from said support and an actuating portion which extends upwardly from said support arm and engages said cleaning solution dispenser whereby lateral movement of said trigger portion causes vertical movement of said actuating portion, and pumps cleaning solution from said reservoir through said dispenser.

11. A cleaning attachment for a vacuum cleaner according to claim 10, wherein the support arm defines an opening through which the distal end of the reservoir extends, said dispenser engaging said support arm at a location adjacent said opening and retaining the support arm in position relative to the reservoir.

12. A cleaning attachment for a vacuum cleaner according to claim 1, further comprising a brush assembly secured to a distal end of said support arm.

13. A cleaning attachment for a vacuum cleaner, comprising:

a cleaning solution reservoir having a closed proximal end and an open distal end;

a suction tube having a proximal end integral with said reservoir proximal end and a distal end spaced from said reservoir;

a manually operable cleaning solution dispenser removably secured to the distal end of said reservoir;

a nozzle assembly secured to the distal end of said suction tube, said nozzle assembly including a wiper and a support arm, said wiper at least partially defining an inlet to said suction tube for dirt and used cleaning solution, and said support arm extending outwardly from said suction tube and beyond said reservoir; and, a sponge assembly secured to a distal end of said support arm.

14. A cleaning attachment for a vacuum cleaner according to claim 13, further comprising:

a trigger assembly secured to said support arm and manually operable to actuate said cleaning solution dispenser and thereby dispense cleaning solution from said reservoir.

15. A cleaning attachment for a vacuum cleaner according to claim 14, wherein said trigger assembly is pivotally mounted to said support arm and includes a trigger portion which extends downwardly from said support and an actuating portion which extends upwardly from said support arm and engages said cleaning solution dispenser whereby lateral movement of said trigger portion causes vertical movement of said actuating portion, and pumps cleaning solution from said reservoir through said dispenser.

16. A cleaning attachment for a vacuum cleaner according to claim 14, wherein the support arm defines an opening through which the distal end of the reservoir extends, said dispenser engaging said support arm at a location adjacent said opening and retaining the support arm in position relative to the reservoir.

17. A cleaning attachment for a vacuum cleaner according to claim 13, wherein the support arm defines an opening through which the reservoir extends.

18. A cleaning attachment for a vacuum cleaner according to claim 17, wherein said cleaning solution dispenser engages and retains said support arm in position relative to said reservoir.

19. A cleaning attachment for a vacuum cleaner, comprising:

a cleaning solution reservoir having a closed proximal end and an open distal end;

a manually operable cleaning solution dispenser removably secured to the distal end of said reservoir;

a suction tube having a proximal end integral with the proximal end of said reservoir and a distal end separate from said reservoir, said suction tube and reservoir cooperating to define a generally U-shaped body;

a nozzle assembly secured to the distal end of said suction tube, said nozzle assembly including a nozzle body, a wiper secured to said nozzle body and defining an inlet for dirt and used cleaning solution, and a support arm extending outwardly from said nozzle body and beyond said reservoir, said support arm defining an opening through which a portion of said reservoir extends, said dispenser engaging the support arm adjacent said opening to secure and retain the support arm relative to the reservoir; and, a trigger assembly pivotally mounted to said support arm and including a trigger portion which extends downwardly from said support and an actuating portion which extends upwardly from said support arm and engages said cleaning solution dispenser whereby lateral movement of said trigger portion causes vertical movement of said actuating portion, and pumps cleaning solution from said reservoir, through said dispenser, and onto a surface to be cleaned.

20. A cleaning attachment for a vacuum cleaner according to claim 19, further comprising a sponge assembly secured to a distal end of said support arm.

21. A cleaning attachment for a vacuum cleaner according to claim 19, further comprising a brush assembly secured to a distal end of said support arm.

* * * * *